US010670270B2

(12) United States Patent
Clemen

(10) Patent No.: US 10,670,270 B2
(45) Date of Patent: Jun. 2, 2020

(54) GAS TURBINE COMBUSTION CHAMBER WITH WALL CONTOURING

(71) Applicant: Rolls-Royce Deutschland Ltd & Co KG, Blankenfelde-Mahlow (DE)

(72) Inventor: Carsten Clemen, Mittenwalde (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 94 days.

(21) Appl. No.: 15/577,679

(22) PCT Filed: Dec. 15, 2016

(86) PCT No.: PCT/EP2016/081220
§ 371 (c)(1),
(2) Date: Nov. 28, 2017

(87) PCT Pub. No.: WO2017/133819
PCT Pub. Date: Aug. 10, 2017

(65) Prior Publication Data

US 2018/0156459 A1 Jun. 7, 2018

(30) Foreign Application Priority Data

Feb. 1, 2016 (DE) ..... 10 2016 201 452

(51) Int. Cl.
*F23R 3/06* (2006.01)
*F23R 3/00* (2006.01)

(52) U.S. Cl.
CPC ..... *F23R 3/06* (2013.01); *F23R 3/002* (2013.01); *F23R 2900/03041* (2013.01)

(58) Field of Classification Search
CPC ... F23R 3/06; F23R 3/002; F23R 2900/03041
(Continued)

(56) References Cited

U.S. PATENT DOCUMENTS 3,593,518 A 7/1971 Gerrard
3,731,484 A 5/1973 Jackson et al.
(Continued)

FOREIGN PATENT DOCUMENTS

DE 1947762 A1 4/1970
DE 2126648 A1 12/1971
(Continued)

OTHER PUBLICATIONS

International Search Report and Written Opinion dated Aug. 10, 2017 from counterpart PCT App PCT/EP2016/081220.
(Continued)

*Primary Examiner* — Arun Goyal
*Assistant Examiner* — Henry Ng
(74) *Attorney, Agent, or Firm* — Shuttleworth & Ingersoll, PLC; Timothy J. Klima

(57) ABSTRACT

A gas turbine combustion chamber with an inner combustion chamber wall and an outer combustion chamber wall, which form an annular combustor, is provided. Mixing air holes are formed in the inner combustion chamber wall and the outer combustion chamber wall in a circumferentially distributed manner. The respective combustion chamber wall is bulged in the area of the mixing air holes towards the interior space of the combustion chamber wall and the mixing air hole is arranged inside the bulge. The mixing air hole is formed at an inflow surface of the bulge with respect to the through-flow direction of the combustion chamber.

8 Claims, 7 Drawing Sheets

(58) Field of Classification Search
USPC ..... 60/722
See application file for complete search history.

(56) References Cited

U.S. PATENT DOCUMENTS

| | | | | |
|---|---|---|---|---|
| 3,735,589 | A | 5/1973 | Caruel et al. | |
| 3,826,082 | A * | 7/1974 | Smuland | F23R 3/08 60/757 |
| 3,995,422 | A * | 12/1976 | Stamm | F23R 3/08 60/757 |
| 4,062,182 | A | 12/1977 | Fehler et al. | |
| 4,852,355 | A | 8/1989 | Kenworthy et al. | |
| 5,775,108 | A | 7/1998 | Ansart et al. | |
| 2009/0100840 | A1* | 4/2009 | Campion | F23R 3/06 60/754 |
| 2010/0011773 | A1 | 1/2010 | Suleiman et al. | |
| 2011/0214428 | A1* | 9/2011 | Shershnyov | F23R 3/06 60/754 |
| 2012/0304658 | A1* | 12/2012 | Schreiber | F23R 3/50 60/752 |
| 2013/0091847 | A1* | 4/2013 | Chen | F23R 3/002 60/752 |
| 2014/0360196 | A1* | 12/2014 | Graves | F23R 3/002 60/753 |
| 2016/0305663 | A1* | 10/2016 | Lebel | F23R 3/002 |

FOREIGN PATENT DOCUMENTS

| | | | |
|---|---|---|---|
| DE | 2460740 | A1 | 7/1976 |
| EP | 2357412 | A2 | 8/2011 |
| FR | 1130169 | A | 1/1957 |
| WO | WO2014149081 | A1 | 9/2014 |

OTHER PUBLICATIONS

German Search Report dated Nov. 4, 2016 from counterpart German App No. 10 2016 201 452.8.

European Office Action dated Sep. 18, 2018 from counterpart European App No. 16822139.8.

* cited by examiner

GAS TURBINE COMBUSTION CHAMBER WITH WALL CONTOURING

CROSS-REFERENCE TO A RELATED APPLICATION

This application is the National Phase of International Application PCT/EP2016/081220 filed Dec. 15, 2016 which designated the U.S.

This application claims priority to German Application No. 10 2016 201 452.8 filed Feb. 1, 2016, which application is incorporated by reference herein.

BACKGROUND

The invention relates to a gas turbine combustion chamber.

In particular, the invention relates to a gas turbine combustion chamber with an inner combustion chamber wall and an outer combustion chamber wall, which form an annular combustor. Mixing air holes through which admixing air is guided into the interior space of the combustion chamber are formed in a circumferentially distributed manner in the inner combustion chamber wall and in the outer combustion chamber wall.

In particular, the invention relates to a gas turbine combustion chamber as it is described in WO 2014/149081 A1. Such a combustion chamber works according to the "counter swirl doublet mixer concept". The combustion chamber, which can be constructed in a modular design with individual modules that arranged around the circumference and connected to each other, comprises an outer and an inner combustion chamber wall, as well as a head plate inside of which recesses, through which fuel nozzles can reach the combustion space, are provided. The combustion chamber itself is embodied with one wall, so that the outer combustion chamber wall and the inner combustion chamber wall are manufactured from formed sheet metal, for example. Mixing air holes, through which admixing air is supplied, are provided in a circumferentially distributed manner. At that, respectively two mixing air holes are positioned in pairs directly next to each other according to the "counter swirl doublet mixer concept". Thus, two mixing air holes are provided per fuel nozzle. According to the state of the art, the mixing air holes are embodied so as to be provided with a substantially tubular air conduit that extends relatively far into the interior space of the combustion chamber. The problem that occurs here is that the air conduits of the mixing air holes are relatively long and, as mentioned, project into the interior space of the combustion chamber and thus into the flame zone. Here, the air conduits can only be cooled to a very limited extent, so that they burn off during operation. But such a burnup leads to a significant change in the temperature distribution at the combustion chamber exit. This also leads to an increase in undesired NOX emissions. Thus, the combustion chambers that have so far been provided in connection with the "counter swirl doublet mixer concept" can be used only to a limited extent.

SUMMARY

The invention is based on the objective to create a gas turbine combustion chamber of the above-mentioned kind, in which the disadvantages of the state of the art are avoided and an effective supply of admixing air is facilitated, while they also have a simple construction as well as a simple, cost-effective manufacturability.

According to the invention, the objective is achieved by gas turbine combustion chamber with features as described herein.

Thus, it is provided according to the invention that the respective combustion chamber wall, namely the inner combustion chamber wall as well as the outer combustion chamber wall, have a bulge towards the interior space of the combustion chamber wall in the area of the mixing air holes, with the mixing air holes being arranged inside the respective bulge.

Thus, it is provided according to the solution according to the invention that convex bulges are embodied in a circumferentially distributed manner, analogously to the distribution of the mixing air holes, as viewed from the interior space of the combustion chamber. The bulges extend in the area of the respective mixing air holes or the paired mixing air holes as they are provided according to the "counter swirl doublet mixer concept". Thus, unlike in the state of the art, there are no tubular air conduits extending from the mixing air holes into the interior space of the combustion chamber. Rather, the combustion chamber wall itself is locally bulged towards the interior space. Since the one or multiple mixing air hole(s) are provided in the respective bulge, the admixing air that exits from the mixing air hole is conducted in a reliable manner into the inner area of the interior space of the combustion chamber.

Multiple bulges are provided according to the invention. The multiple bulges are preferably distributed at the circumference and which correspond to the number of the mixing air holes or the mixing air hole pairs. The result is a wave-like contour of the combustion chamber wall distributed about the inner circumference of the annular combustor in the area of the mixing air holes that are arranged at the circumference. This contour is provided at the inner combustion chamber wall as well as at the outer combustion chamber wall.

According to the invention, the bulge begins preferably axially in front of the respective mixing air hole(s) and ends axially behind the mixing air holes. Here, the term "axially" refers to the through-flow direction of the combustion chamber or to its central axis in the respectively regarded sectional view. Since we are looking at an annular combustor in the present case, the central axes for the regarded individual burners are arranged on a truncated cone, as is also shown by the state of the art. Thus, the respective central axes are in parallel to engine axis only in the axial sectional plane.

In a particularly advantageous further development of the invention, it is provided that the bulges are arranged so as to be offset with respect to one another at the inner combustion chamber wall and at the outer combustion chamber wall with respect to a radial sectional plane, so that the mixing air holes that are provided inside the bulges follow the "counter swirl doublet mixer concept".

As mentioned, the invention is not limited to the "counter swirl doublet mixer concept", but rather it is also possible to provide only one mixing air hole inside a bulge. In contrast, the mixing air holes are arranged in pairs according to the "counter swirl doublet mixer concept".

The bulges preferably have rounded lateral surfaces to improve the flow characteristics through the interior space of the combustion chamber. Here, it is in particular advantageous if, with respect to the through-flow direction of the combustion chamber, the bulges respectively have an inflow surface towards the combustion chamber wall, with the inflow surface forming a smaller angle than the outflow surface. This also serves to ensure efficient guidance of the flow through the interior space of the combustion chamber.

The mixing air holes can have differing diameters, in particular if they are arranged in pairs.

According to the invention further the respective mixing air hole is provided at an inflow surface of the bulge. Also in this way, the guidance of the flow is optimized in connection with an improved intake of admixing air.

The height of the bulges is preferably between 7.5% and 25% of the total height of the interior space of the combustion chamber.

In order to improve cooling of the combustion chamber wall, it can be advantageous to provide cooling air holes, in particular effusion holes, in the wall of the bulges. Through these, cooling air that serves for cooling the outer or the inner combustion chamber wall is introduced.

In the single-wall combustion chamber construction made of sheet metal which is regarded herein, the bulges according to the invention can be created by means of deep-drawing or pressing the sheet metal of the combustion chamber by using suitable tools. Thus, local bulges are pressed in or inserted from the exterior side of the respective combustion chamber wall towards the interior space of the combustion chamber through a suitable forming method. The mixing air holes can be formed in the bulges by means of milling, laser cutting or the like. The additional cooling air holes/effusion holes can be created by means of laser drilling, or similar methods.

BRIEF DESCRIPTION OF THE DRAWINGS

In the following, the invention is described based on an exemplary embodiment in connection with the drawing.

DETAILED DESCRIPTION

Figure 1:
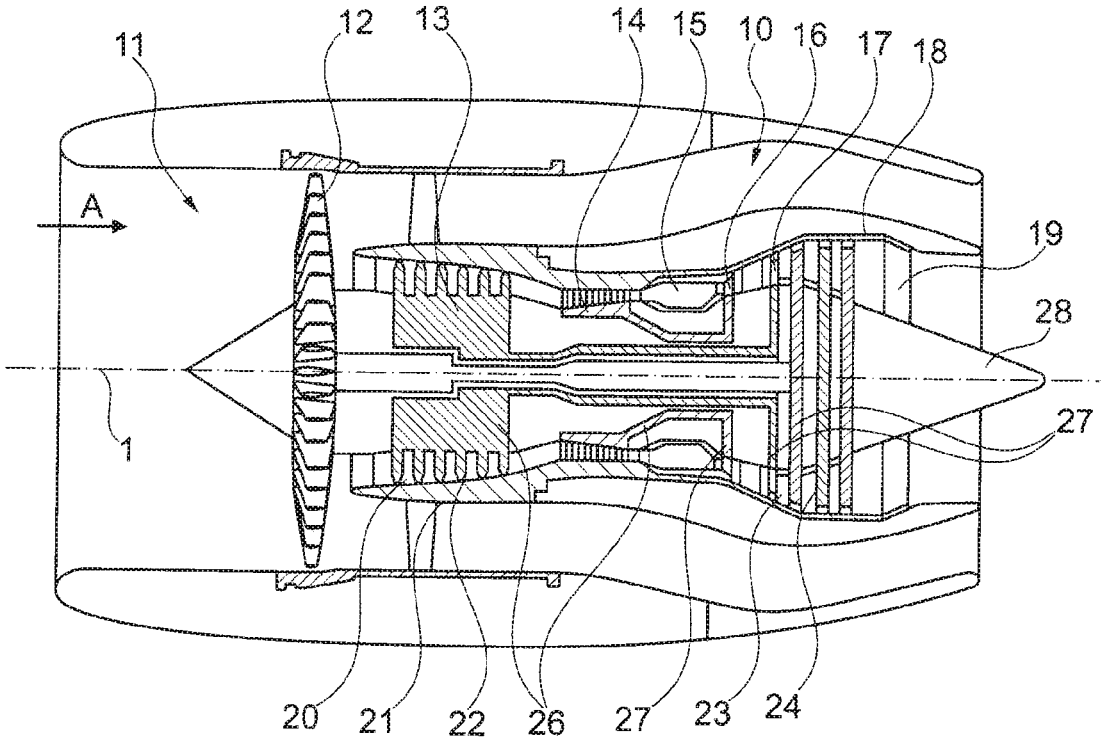
FIG. 1 shows a schematic rendering of a gas turbine engine according to the present invention.

The gas turbine engine 10 according to FIG. 1 represents a general example of a turbomachine in which the invention may be used. The engine 10 is configured in a conventional manner and comprises, arranged successively in flow direction, an air inlet 11, a fan 12 that rotates inside a housing, a medium-pressure compressor 13, a high-pressure compressor 14, a combustion chamber 15, a high-pressure turbine 16, a medium-pressure turbine 17, and a low-pressure turbine 18 as well as an exhaust nozzle 19, which are all arranged around a central engine axis 1.

The medium-pressure compressor 13 and the high-pressure compressor 14 respectively comprise multiple stages, of which each has an arrangement of fixedly arranged stationary guide vanes 20 that are generally referred to as stator vanes and project radially inward from the core engine shroud 21 through the compressors 13, 14 into a ring-shaped flow channel. Further, the compressors have an arrangement of compressor rotor blades 22 that project radially outward from a rotatable drum or disc 26, and are coupled to hubs 27 of the high-pressure turbine 16 or the medium-pressure turbine 17.

The turbine sections 16, 17, 18 have similar stages, comprising an arrangement of stationary guide vanes 23 projecting radially inward from the housing 21 through the turbines 16, 17, 18 into the ring-shaped flow channel, and a subsequent arrangement of turbine blades/vanes 24 projecting outwards from the rotatable hub 27. During operation, the compressor drum or compressor disc 26 and the blades 22 arranged thereon as well as the turbine rotor hub 27 and the turbine rotor blades/vanes 24 arranged thereon rotate around the engine axis 1.

Figure 2:
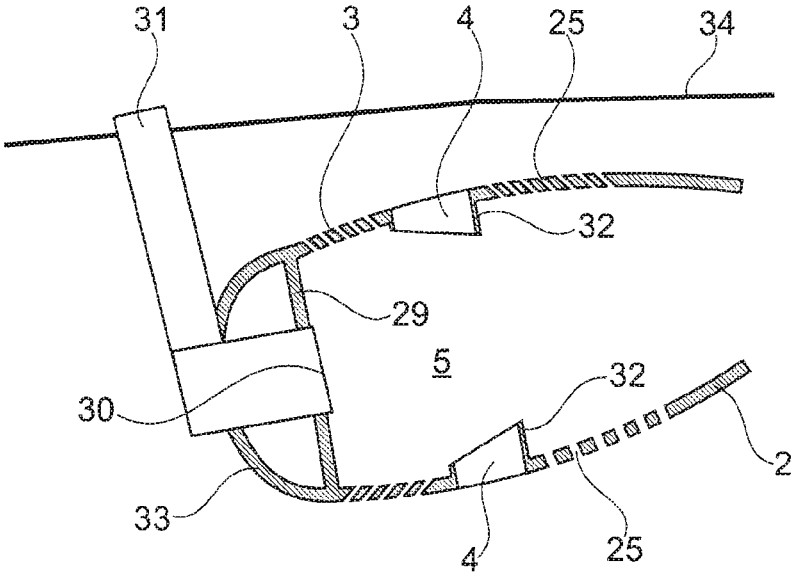
Prior Art Fig. 2
FIG. 2 shows a simplified axial section view of a combustion chamber according to the state of the art.
Figure 3:
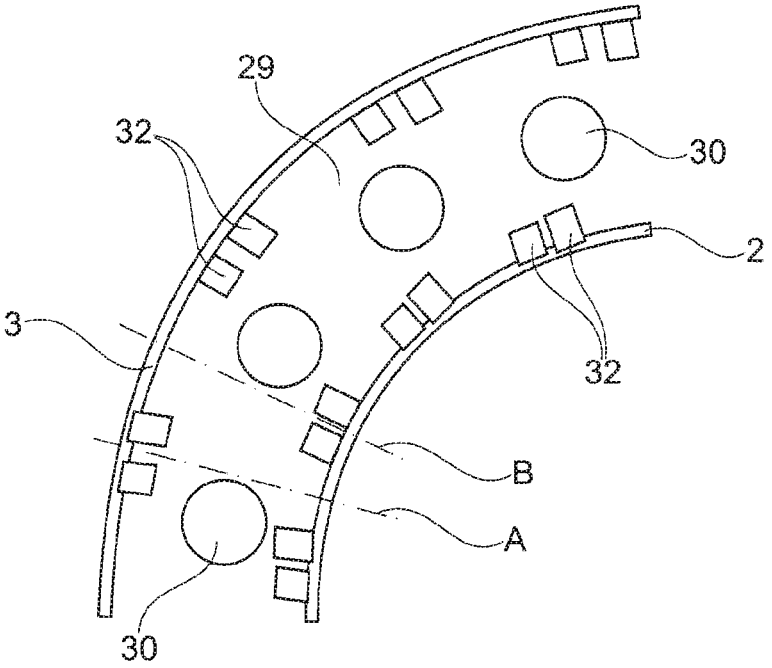
Prior Art Fig. 3
FIG. 3 shows a view, analogous to FIG. 2, in a radial sectional plane according to the state of the art.

FIGS. 2 and 3 respectively show combustion chamber constructions according to the "counter swirl doublet mixer concept" according to the state of the art. FIG. 2 shows an axial section view in a simplified rendering. Here, an annular combustor is shown, having an inner combustion chamber wall 2 and an outer combustion chamber wall 1, and being provided with a head plate 29 inside of which recesses 30 are formed in a circumferentially distributed manner (see FIG. 3). They serve for receiving fuel nozzles 31, as it is known from the state of the art.

Further, FIGS. 2 and 3 show, in the axial sectional plane or radial sectional plane (FIG. 3), multiple mixing air holes 4 that are arranged in a circumferentially distributed manner and serve for supplying mixing air to an interior space 5 of the combustion chamber. The mixing air holes 4 are provided with air conduits 32 that project into the interior space 5 in a tubular manner, as particularly shown in FIG. 2.

A combustion chamber head is indicated by reference sign 33. The reference sign 34 identifies an outer housing inside of which the combustion chamber is arranged. The inner combustion chamber wall 2 as well as the outer combustion chamber wall 3 are provided with cooling air holes 25 which serve as effusion cooling holes.

As follows from FIGS. 2 and 3, the respective air conduits 32 project far into the interior space 5 of the combustion chamber and are therefore in danger of burning off.

FIGS. 4 to 10 explain an exemplary embodiment of the invention. Here, identical parts are indicated by the same reference signs, as in FIGS. 2 and 3, so that repeated descriptions may be omitted.

Figure 4:
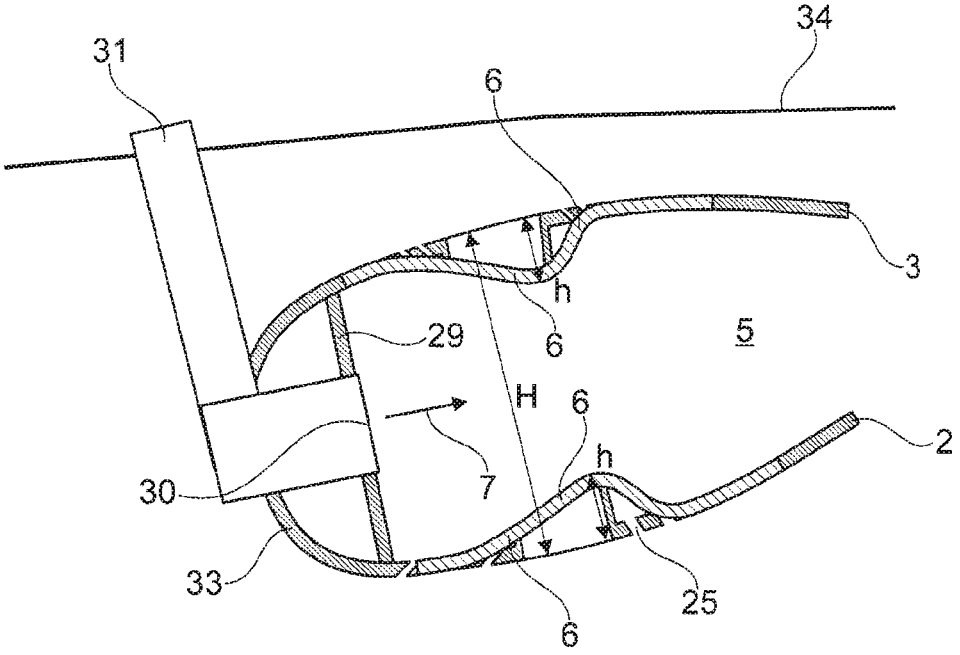
FIG. 4 shows a simplified sectional view of an exemplary embodiment according to the invention, analogous to FIG. 2.

FIG. 4 shows a sectional view analogous to FIG. 2. Here, the through-flow direction 7 is indicated by an arrow. It illustrates the main flow through the fuel nozzle 31.

As will be described in more detail below, the bulges 6 are provided at the inner combustion chamber wall 2 as well as at the outer combustion chamber wall, with the bulges 6 being formed in a convex manner as viewed from the interior space 5, and having rounded contours. The total height H of the combustion chamber can be seen in FIG. 4, representing the respective height of the interior space between the inner combustion chamber wall 2 and the outer combustion chamber wall 3. The height h of the bulges 6 is also shown in FIG. 4. It is between 7.5% and 25% of the total height H.

Figure 5:
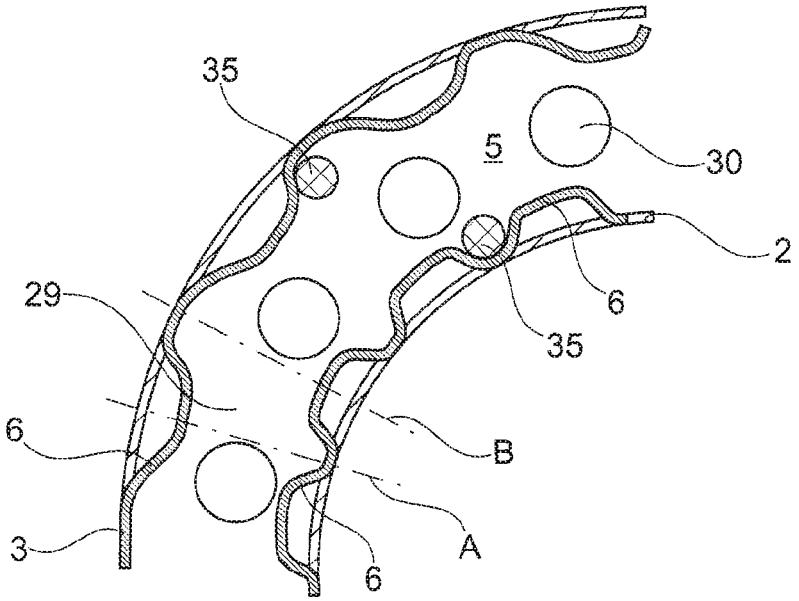
FIG. 5 shows a radial section view of the exemplary embodiment according to FIG. 4 in a rendering analogous to FIG. 3.
Figure 6:
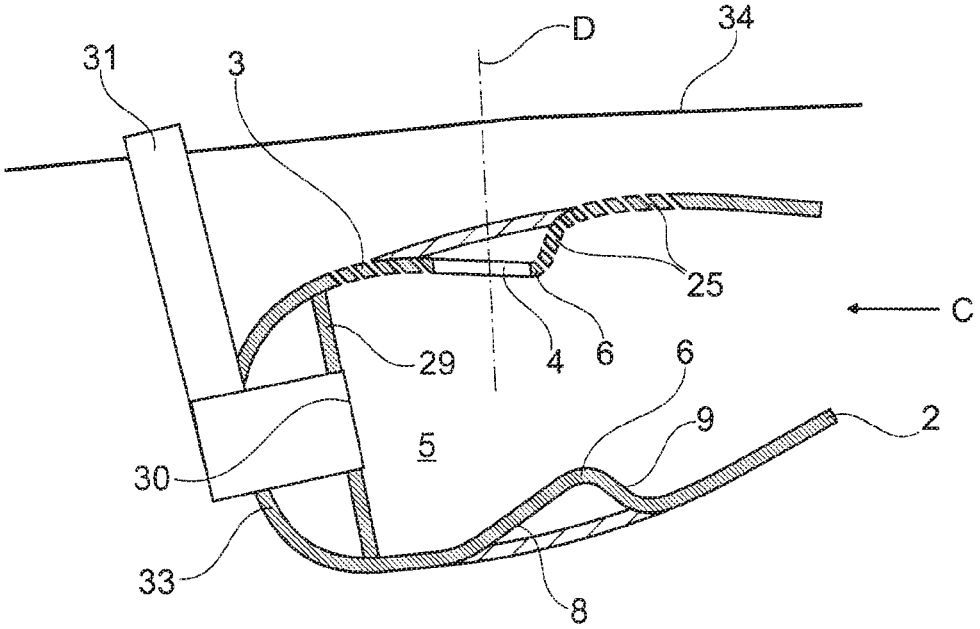
FIG. 6 shows an axial section view according to the sectional line A of FIG. 5.

FIG. 5 shows a view C according to FIG. 6, and thus a view from the outflow side of the combustion chamber in a radial sectional plane. Here, the recesses 30 for the fuel nozzles 31 are shown. The inner combustion chamber wall 2 as well as the outer combustion chamber wall 3 are provided with bulges 6 that are circumferentially distributed in the area of the mixing air holes 4, with the bulges 6 extending into the interior space 5 of the combustion chamber, and thus leading to a wave-shaped contour of the combustion chamber walls 2, 3 in in the sectional view.

FIG. 5 shows a simplified rendering of tools 35, which will be described in the following in connection with FIGS. 9 and 10. These tools 35 serve for manufacturing the bulges 6.

Figure 7:
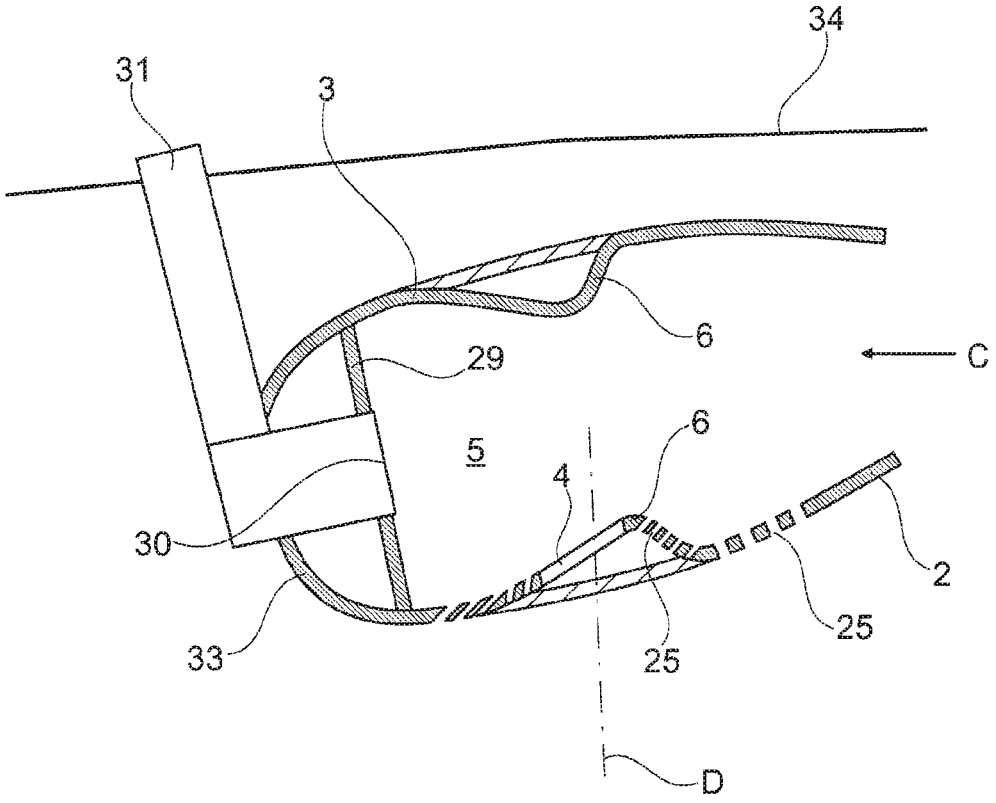
FIG. 7 shows a view, analogous to FIG. 6, according to the sectional line B of FIG. 5.
Figure 8:
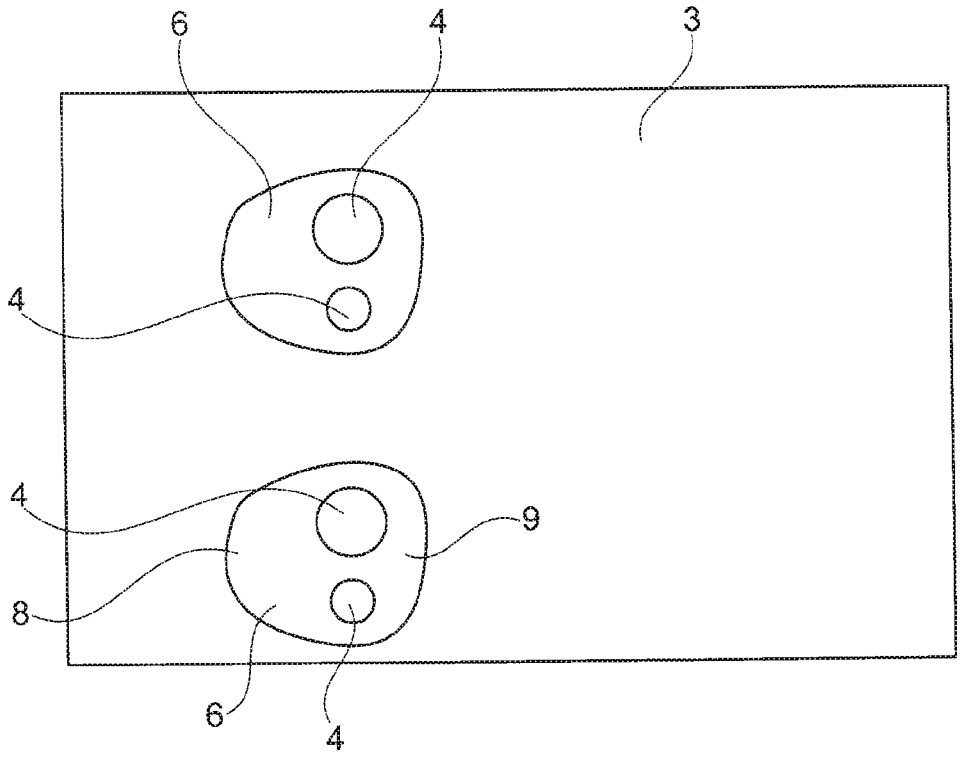
FIG. 8 shows a schematic interior view of a partial area of the combustion chamber wall.

FIG. 5 shows two sectional lines A and B arranged in the radial direction. Sectional views along these sectional lines A and B are shown in FIGS. 6 and 7. FIG. 6 shows a view based on the sectional line A, and illustrates the shape and arrangement of the bulges 6. They have an inflow surface 8 as well as an outflow surface 9 in the through-flow direction 7 (see FIG. 4). As can be seen, the inflow surface 8 is arranged at a flatter angle 25 with respect to the respective combustion chamber wall 2, 3 than the outflow surface 9. This is also illustrated in the view of FIG. 8. As can be seen here, the bulges 6 do not have to be circular. The geometry is based on the dimensioning and the constructional type of the combustion chamber. Also, the mixing air holes 4 provided in the respective bulge 6 can have differing diameters, analogous to the rendering in FIG. 3 and to the "counter swirl doublet mixer concept".

As shown in FIGS. 6 and 7, the walls of the bulge 6 are provided with cooling air holes 25.

A synopsis of FIGS. 5 to 7 shows that, in the area of the mixing air holes located in a middle area of the cross-section of the annular combustor, the bulges 6 according to the invention are provided in an alternating manner at the inner combustion chamber wall 2 and the outer combustion chamber wall 3, thus matching the alternating arrangement of the mixing air holes (see FIG. 3). They can be differently dimensioned at the inner combustion chamber wall 2 and at the outer combustion chamber wall 3. The height h and 5 thus the penetration depth of the bulges is preferably chosen in such a manner that the admixing air that enters through the mixing air holes 4 is guided out in the same manner as in the state of the art (see FIG. 3), in which additional tubular air conduits 32 are provided.

FIGS. 6 and 7 illustrate that the cooling air holes 25 are arranged and positioned in such a manner inside the walls of the bulge 6 that an effective cooling of the combustion chamber wall results in the area of the bulges 6, as well.

Figure 9:
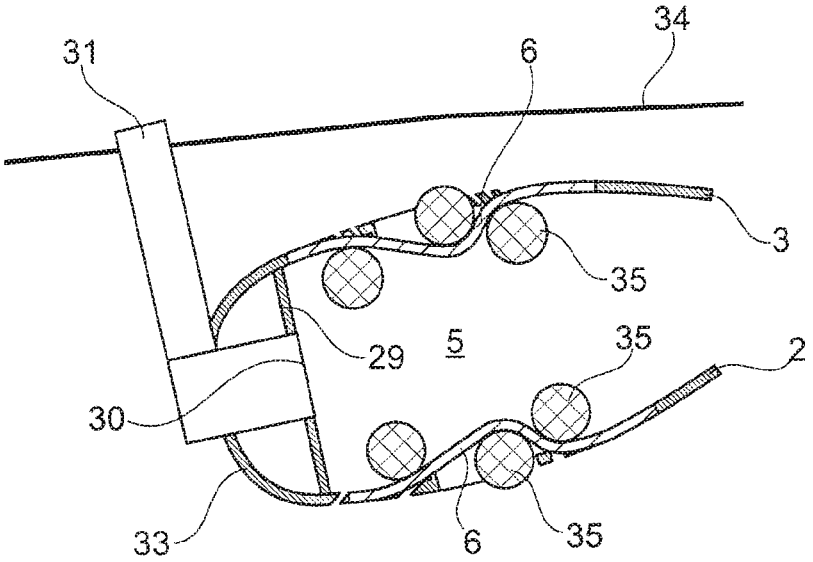
FIG. 9 shows a sectional view, analogous to FIG. 4, including the rendering a manufacturing option.
Figure 10:
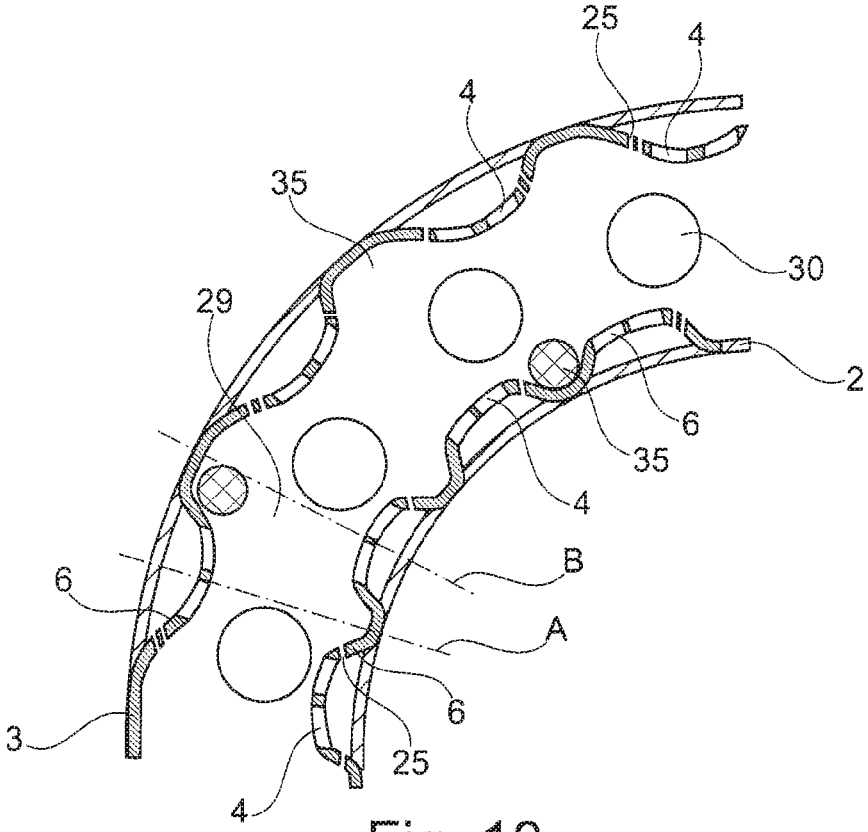
FIG. 10 shows a sectional view, analogous to FIG. 5.

FIGS. 9 and 10 show possibilities for manufacturing the bulges 6 according to the invention, as they have already been indicated in FIG. 5. They can be pressed in from the outside by means of suitable tools 35, which have a similar effect as a molding die. Here, those edge areas of the outer and the inner combustion chamber wall 2, 3 where no bulge 6 is to be created are supported by suitable tools 35. At that, the tools that are pressed in from the outside can have a suitably selected shape to create the contour of the bulges 6, which can for example be seen in FIG. 8. Subsequently, cooling air holes 25 are formed in the bulges 6, for example by means of laser drilling or the like, while the mixing air holes 4 can for example be created by means laser cutting. The radiuses of the recesses are for example 10 to 15 mm, so that they do not compromise the stability of the structural components and facilitate processing by tools 35. These radiuses also determine the beginning and the end of the respective bulges in the axial direction as well as in the circumferential direction. As shown in the Figures, the bulge 6 is provided with an inflow surface 8 and an outflow surface 9. The mixing air holes 4 can be formed in an inflow surface 8, but it is also possible to provide them at the apex of the respective bulge 6. Comparing the positions at the inner combustion chamber wall 2 and the outer 30 combustion chamber wall 3, the bulges 6 are offset with respect to each other about the circumference in order to supply the admixing air according to the "counter swirl doublet mixer concept", as shown in a simplified manner in FIG. 3.

According to the above explanations, the bulges 6 can be embodied in a symmetrical as well as in an asymmetrical manner in the axial direction as well as in the radial direction. This makes it possible to optimize the flow conditions in the interior space 5 of the combustion chamber and to adjust them to the "counter swirl doublet mixer concept". What thus results in total is an offset arrangement, as explained in FIGS. 5 and 10, for example.

PARTS LIST 1 engine axis
2 inner combustion chamber wall
3 outer combustion chamber wall
4 mixing air hole
5 interior space
6 bulge
7 through-flow direction
8 inflow surface
9 outflow surface
10 gas turbine engine/core engine
11 air inlet
12 fan
13 medium-pressure compressor (compactor)
14 high-pressure compressor
15 combustion chamber
16 high-pressure turbine
17 medium-pressure turbine
18 low-pressure turbine
19 exhaust nozzle
20 guide vanes
21 core engine housing
22 compressor rotor blades
23 guide vanes
24 turbine rotor blades
25 cooling air hole
26 compressor drum or compressor disk
27 turbine rotor hub
28 outlet cone
29 head plate
30 recess
31 fuel nozzle
32 air conduit
33 combustion chamber head
34 outer housing
35 tool

The invention claimed is:

1. A gas turbine combustor, comprising:

an annular combustor including an inner combustion chamber wall and an outer combustion chamber wall;

an interior space defining a combustion chamber between the inner combustion chamber wall and the outer combustion chamber wall;

a head plate inside of which recesses are formed for receiving a plurality of fuel nozzles;

at least one bulge located downstream from each of the plurality of fuel nozzles and in at least one chosen from the inner combustion chamber wall and the outer combustion chamber wall, wherein the at least one bulge is formed by a portion of the at least one chosen from the inner combustion chamber wall and the outer combustion chamber wall projected inwardly toward the interior space;

wherein the at least one bulge includes:

an inner bulge arranged at the inner combustion chamber wall;

an outer bulge arranged at the outer combustion chamber wall;

wherein each of the inner bulge and the outer bulge includes:

an inflow surface at an axially front wall of each of the inner bulge and the outer bulge, wherein the inflow surface is angled toward a head of the gas turbine combustor;

an outflow surface at an axially back wall of each of the inner bulge and the outer bulge, wherein the outflow surface is angled away from the head of the gas turbine combustor;

a bottom area located between the inflow surface and the outflow surface, wherein the bottom area includes a portion of each of the inner bulge and the outer bulge projecting furthest into the interior space; and at least one mixing air hole arranged inside each of the inner bulge and the outer bulge, and wherein the at least one mixing air hole is positioned in the inflow surface; and wherein the bottom area of the inner bulge and the bottom area of the outer bulge are arranged so as to be offset in a circumferential direction with respect to each other.

2. The gas turbine combustor according to claim 1, wherein the inner bulge includes a plurality of inner bulges circumferentially distributed around the inner combustion chamber wall and the outer bulge includes a plurality of outer bulges circumferentially distributed around the outer combustion chamber wall.

3. The gas turbine combustor according to claim 1, wherein the at least one mixing air hole for at least one chosen from the inner bulge and the outer bulge includes a plurality of mixing air holes arranged inside the at least one chosen from the inner bulge and the outer bulge.

4. The gas turbine combustor according to claim 1, wherein at least one chosen from the inner bulge and the outer bulge has a rounded lateral surface.

5. The gas turbine combustor according to claim 1, wherein at least one chosen from:

the inflow surface of the inner bulge and the inner combustion chamber wall form an inner bulge inflow surface angle, wherein the outflow surface of the inner bulge and the inner combustion chamber wall form an inner bulge outflow surface angle, and wherein the inner bulge inflow surface angle is larger than the inner bulge outflow surface angle; and the inflow surface of the outer bulge and the outer combustion chamber wall form an outer bulge inflow surface angle, wherein the outflow surface and the outer combustion chamber wall form an outer bulge outflow surface angle; and wherein the outer bulge inflow surface angle is larger than the outer bulge outflow surface angle.

6. The gas turbine combustor according to claim 1, wherein the at least one mixing air hole includes further comprising a first mixing air hole and a second mixing air hole, wherein a diameter of the first mixing air hole is different than a diameter of the second mixing air hole.

7. The gas turbine combustor according to claim 1, wherein a height of at least one chosen from the inner bulge and the outer bulge is between 7.5% and 25% of a height of the gas turbine combustor.

8. The gas turbine combustor according to claim 1, further comprising a cooling air hole in at least one chosen from the axially front wall and the axially back wall of at least one chosen from the inner bulge and the outer bulge.

* * * * *